United States Patent [19]

Helming

[11] 4,014,642

[45] Mar. 29, 1977

[54] SHAFT COOLER

[75] Inventor: Bernd Helming, Enniger, Germany

[73] Assignee: Polysius AG, Neubeckum, Germany

[22] Filed: Jan. 21, 1976

[21] Appl. No.: 650,847

[30] Foreign Application Priority Data

Feb. 5, 1975 Germany ..... 2504782

[52] U.S. Cl. ..... 432/77; 432/78; 432/106; 241/67; 241/66; 34/170; 34/62

[51] Int. Cl.² ..... F27D 15/02

[58] Field of Search ..... 432/77–80, 432/82, 85, 106; 34/62, 65, 170, 174; 241/67, 66

[56] References Cited

UNITED STATES PATENTS

| | | | |
|---|---|---|---|
| 1,988,473 | 1/1935 | Bennett | 241/67 |
| 2,108,118 | 2/1938 | Greenawalt | 432/77 |
| 2,350,644 | 6/1944 | Simpson et al. | 34/170 |
| 2,556,486 | 6/1951 | Smith | 241/67 |
| 3,362,083 | 1/1968 | Galer | 432/77 |
| 3,815,253 | 6/1974 | Deussner | 432/78 |

FOREIGN PATENTS OR APPLICATIONS

| | | | |
|---|---|---|---|
| 1,558,609 | 6/1971 | Germany | 432/77 |
| 153,479 | 11/1920 | United Kingdom | 34/170 |

*Primary Examiner*—John J. Camby
*Assistant Examiner*—Henry C. Yuen
*Attorney, Agent, or Firm*—Marshall & Yeasting

[57] ABSTRACT

The shaft cooler comprises a plurality of power-driven adjacent horizontal hollow perforated comminuting rolls. An upper section of the shaft cooler is adapted to hold a layer of material from 50 to 100 cm. deep above the rolls. Cooling air is supplied to the interior of each roll to cause it to be discharged into such layer of material. An aftercooling section below the rolls is provided with means for indirect cooling of the comminuted material and has a depth which is several times that of said layer.

10 Claims, 2 Drawing Figures

SHAFT COOLER

BACKGROUND OF THE INVENTION

The invention relates to a shaft cooler having a plurality of driven perforated comminuting rolls which are arranged horizontally adjacent each other beneath a layer of the material to be cooled, the rolls and the material layer disposed thereabove being cooled by a cooling air flow passing upwardly through the material layer.

For cooling calcined, burnt or sintered material, grid coolers of various types, drum coolers and tube coolers are known. However, in some cases they have a relatively poor efficiency and in some cases they are very expensive to construct.

For these reasons, attempts have been made recently to develop shaft cooler designs which combine the advantages of low plant cost, good cooling efficiency and uniform quality of the cooled product.

It has been found expedient to provide the shaft cooler with a plurality of driven comminuting rolls arranged horizontally adjacent each other to comminute large agglomerations of material after a certain pre-cooling but prior to an aftercooling, in order to prevent inadequately comminuted material lumps whose cores are still hot from being discharged from the cooler.

In a known shaft cooler of the aforementioned type (DT-OS 1,558,609) there is disposed above the comminuting rolls a relatively high material column (which in a practical construction of such a shaft cooler amounts to several meters). The cooling air is supplied through a space free of material beneath the comminuting rolls, cools the rolls and then passes upwardly through the column of material disposed thereabove. The shaft cross-section tapers upwardly in such a manner that at least the upper region of the material column is held by the increased air velocity in a state similar to a fluidized bed.

However, the effect aimed at with this shaft cooler turns out to be hardly attainable in practice because the cooling air rising in the cooling shaft (in particular at the necessary high pressure) tends to seek preferred flow passages. In any case, a reliable distribution and loosening, similar to that in a fluidized bed, of the material in the uppermost zone of the high material column, can only be obtained with a very great expenditure of energy.

A further disadvantage of this known shaft cooler is that the material lumps comminuted by the comminuting rolls disposed at the lower end of the high material column are not subjected to adequate aftercooling in the cooling shaft when they simply fall through the space free of material provided beneath the comminuting rolls, through which cooling air is passed, before they reach a discharge hopper. On the other hand, if for this reason a special aftercooling means (for example a grid cooler) must be provided, the desired advantage of less expenditure on plant is lost.

SUMMARY OF THE INVENTION

The invention is therefore directed to the problem of avoiding these disadvantages and constructing a shaft cooler of the type hereinbefore described in such a manner that with a simple structure a particularly good cooling efficiency is achieved.

According to the invention this problem is solved in that the depth of the material layer disposed above the rolls (measured from the apex of the rolls) is between 50 cm and 1 m, that furthermore the cooling air is supplied to the interior of the rolls and is discharged from the rolls, and that beneath the rolls an aftercooling zone with indirect cooling is provided, the depth of which is several times the depth of the layer present above the rolls.

In the tests on which the invention was based it was surprisingly found that it is not necessary to have a state similar to a fluidized bed in order to obtain a uniform depth of the material layer disposed above the rolls and a uniform air distribution over the entire cross-section of the shaft. For if the depth of the material layer disposed above the rolls is within the range according to the invention (between 50 and 100 cm), the rotating comminuting rolls themselves can give an ideal homogenization of the layer of material disposed above the rolls. It is then only necessary to make the velocity of the cooling air great enough for optimum cooling conditions to be obtained in the material layer disposed above the rolls; it is not necessary to produce a fluidized bed, which requires a great expenditure of energy.

Since the cooling air supplied through the rolls mainly emerges in the apex regions of the rolls, the material particles disposed in these regions are subjected to the most pronounced loosening effect by the cooling air. However, due to the rotational movement of the rolls these material particles are moved down into the less intensively aerated spaces between adjacent rolls, and as a result within a short time practically the entire material layer disposed above the rolls comes into very intense contact with the cooling air.

The aftercooling zone disposed beneath the rolls according to the invention, the depth of which is several times the depth of the layer present above the rolls, ensures adequate and uniform aftercooling of the material comminuted by the rolls. Due to the relatively great depth of this aftercooling zone, at the same time the cooling air supplied through the rolls is constrained in a simple manner to flow exclusively upwardly through the material layer disposed above the rolls, because the deep aftercooling zone offers adequate resistance to said cooling air escaping downwardly.

DESCRIPTION OF THE PREFERRED EMBODIMDENT

Figure 1:
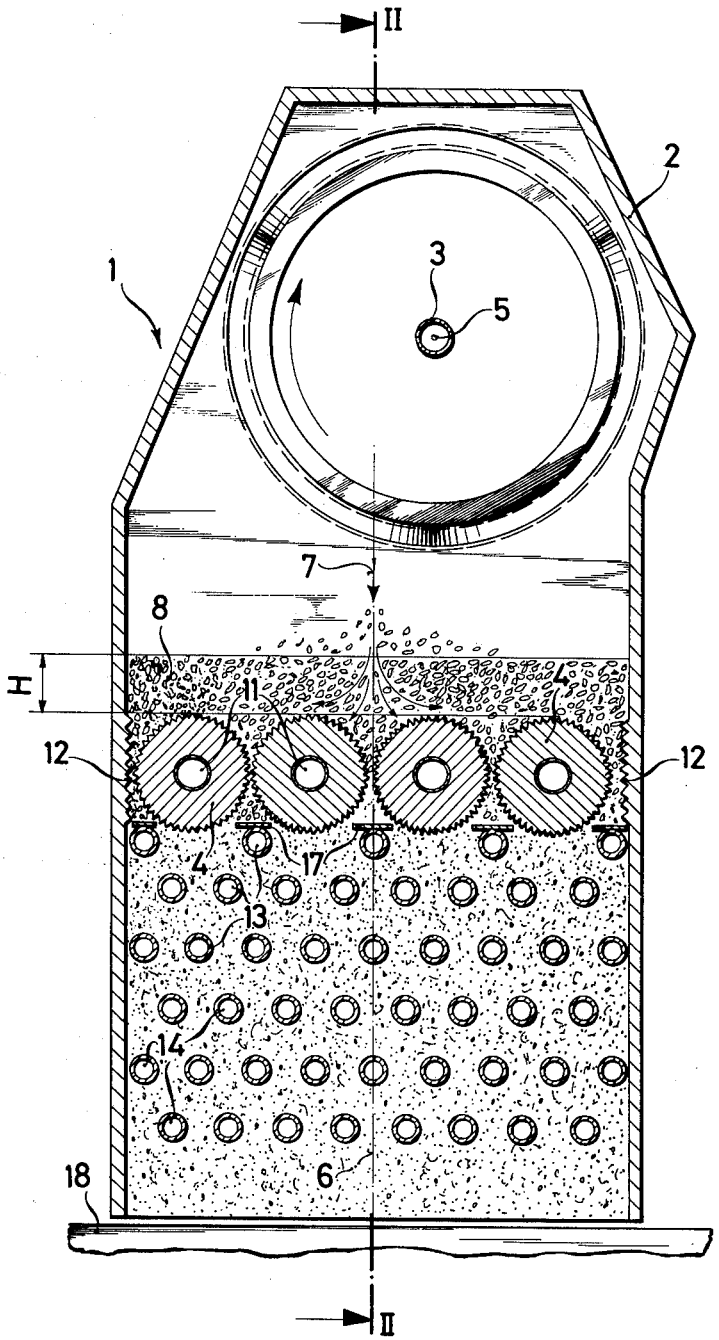
FIG. 1 is a vertical section through a shaft cooler according to the invention.

The shaft cooler 1 illustrated in the drawings follows a rotary tubular kiln 2 which is fired in a conventional manner by a burner 3. The exit air of the shaft cooler 1 serves as secondary air for the burner 3.

The shaft cooler 1 has a rectangular cross-section and is provided with a plurality of driven comminuting rolls 4 arranged horizontally adjacent each other. The rolls 4 are disposed parallel to the narrow sides of the shaft. The narrow sides of the shaft lie substantially parallel to the axis 5 of the rotary kiln 2. The vertical centre axis 6 of the shaft cooler is offset with respect to the kiln axis 5 in such a manner that the material discharged from the rotary tubular kiln 2 (arrow 7) falls substantially in the centre region of the shaft.

Figure 2:
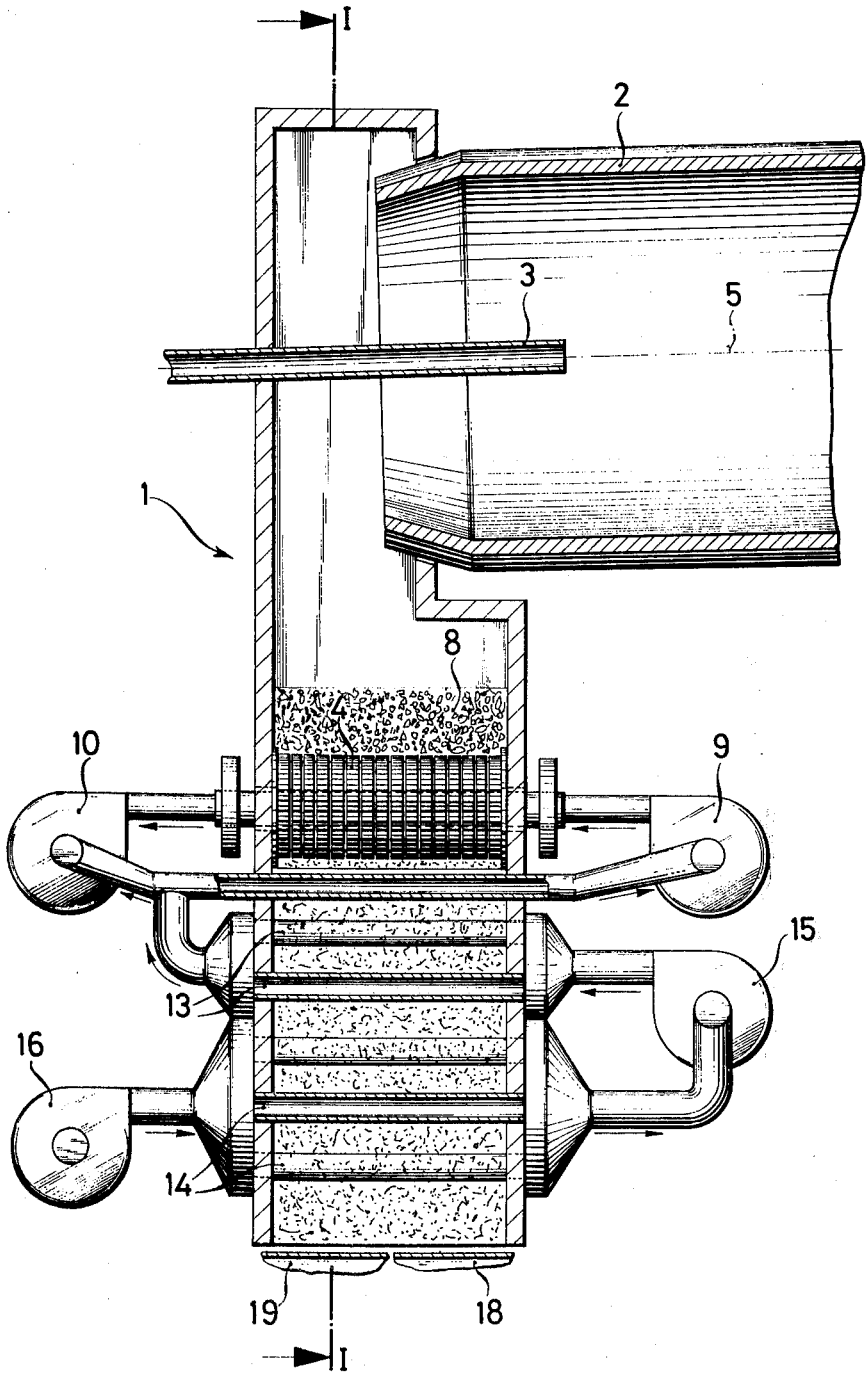
FIG. 2 is a transverse section through the shaft cooler.

The shaft cooler 1 generally comprises three zones (FIG. 2):

The uppermost zone is formed by the material layer 8 lying above the rolls 4. Its height H is at least 50 cm and at most about 1 m.

The middle zone of the shaft cooler 1 is formed by the rolls 4 serving to comminute and distribute the material. These rolls 4 preferably have chromium nickel steel cast surfaces with air-discharge slits and breaking teeth. Each roll preferably has its own drive and its own cooling air fan 9 or 10. The cooling air connections 11 and the associated fans 9 and 10 of adjacent rolls 4 are preferably provided on opposite end faces of the rolls.

In the embodiment illustrated the direction of rotation of the rolls 4 is such that the two roll pairs convey material outwardly from the center of the shaft. Generally, this direction of rotation will be the most convenient in order to distribute the material introduced in the center region of the shaft towards both sides to form a layer of uniform thickness. At the two narrow sides of the shaft additional stationary breaking jaws 12 are provided at the level of the rolls 4.

The third zone of the shaft cooler 1 is constructed as an aftercooling zone with indirect cooling. In the embodiment illustrated it contains two superimposed groups of cooling tubes 13 and 14, each group having associated therewith a separate fan 15 or 16 respectively and the two groups being supplied with cooling air from opposite sides of the shaft. The air leaving the cooling tubes 13 is supplied through the fans 9 and 10 to the rolls 4. It then passes through the perforated surfaces of said rolls 4 and therafter flows through the material layer 8 disposed above the rolls.

Beneath the rolls 4, substantially below the gaps between adjacent rolls, there are horizontal baffles 17 which prevent material falling directly through the upper region of the aftercooling zone.

At the lower end of the aftercooling zone formed by the cooling tubes 13, 14, preferably two discharge members 18, 19 conveying the material alternately to opposite sides are provided (for example discharge shoes or chains). In this manner the material column falls uniformly as a whole although in regular alternation in individual parts. This method of discharge promotes the movement in the aftercooling zone and thus the aftercooling as a whole.

The following particulars, which are however only by way of example, further illustrate the invention and apply to a shaft cooler having a capacity of 3000 tato: The shaft cooler having a cross-section of 4 × 8.4 m comprises a first cooling zone (material layer 8) having a thickness of 1 m, rolls 4 having a diameter of 1.8m and an indirect aftercooling zone having a height of 6.5 m. The material (for example cement clinker) resides in the layer 8 for about 23 minutes and in the aftercooling zone for about 147 minutes.

The discharge of the cooler is regulated by the speed of rotation of the rolls 4 and/or by the speed of the discharge members 18, 19.

To reduce the wear on the rolls 4 the layer height may be controlled so that a small space free of material forms beneath the rolls.

What I claim is:

1. A shaft cooler comprising a plurality of power-driven adjacent horizontal hollow perforated comminuting rolls, a material — holding upper shaft section immediately above said rolls, said upper section having a height of 50 to 100 cm., means for delivering material at the upper end of said upper section, an aftercooling shaft section immediately below said rolls, the height of which is several times that of the upper section, means for withdrawing material at the lower end of said aftercooling section as material is delivered at the upper end of the upper section, thereby maintaining both sections substantially full of material, means in the aftercooling section for indirectly cooling the material, and means for supplying cooling air to the interior of each roll, thereby causing the air to flow upward through the layer of material in the upper shaft section.

2. A shaft cooler according to claim 1 having an elongated rectangular horizontal cross-section, the rolls being parallel to the two narrower sides of the shaft cooler.

3. A shaft cooler according to claim 2 having an even number of comminuting rolls, and a rotary tubular kiln arranged to discharge material onto the upper end of the upper shaft section, the discharge path of said material being in vertical alignment with the gap between the two central rolls.

4. A shaft cooler according to claim 3 wherein the rolls comprise at least one roll on one side rotating in a direction to carry the overlying material toward that side, and an equal number of rolls on the other side rotating in the opposite direction, to level out the material above the rolls.

5. A shaft cooler according to claim 1 wherein each roll is provided with a separate fan for supplying cooling air thereto.

6. A shaft cooler according to claim 5 wherein adjacent rolls are supplied with cooling air at opposite ends.

7. A shaft cooler according to claim 1 wherein the aftercooling section comprises two superimposed groups of cooling tubes, each group being provided with a separate fan for supplying cooling air thereto, and the two fans being arranged on opposite sides of the shaft cooler.

8. A shaft cooler according to claim 1 wherein the aftercooling section has means for indirect cooling of the comminuted material by means of air, and has connections for supplying the used air to the comminuting rolls.

9. A shaft cooler according to claim 1 wherein a horizontal baffle is arranged beneath each gap between two adjacent rolls, to distribute the comminuted material.

10. A shaft cooler according to claim 1 wherein discharging members are provided at the bottom of the aftercooling section for conveying material towards opposite sides of the shaft cooler.

* * * * *